United States Patent [19]

Ohmann et al.

[11] 4,338,802

[45] Jul. 13, 1982

[54] AGITATOR MOUNTED FILTER FOR AN AUTOMATIC WASHER

[75] Inventors: William Ohmann, St. Joseph Township, Berrien County; Edward E. Wiessner, Lincoln Township, Berrien County, both of Mich.

[73] Assignee: Whirlpool Corporation, Benton Harbor, Mich.

[21] Appl. No.: 163,585

[22] Filed: Jun. 27, 1980

[51] Int. Cl.[3] ..... D06F 13/02

[52] U.S. Cl. ..... 68/18 FA; 68/134

[58] Field of Search ..... 68/18 FA, 134

[56] References Cited

U.S. PATENT DOCUMENTS

| | | | |
|---|---|---|---|
| 1,795,395 | 3/1931 | Hoke | 68/134 |
| 2,942,444 | 6/1960 | Abresch | 68/18 FA X |
| 2,959,045 | 11/1960 | Cartwright | 68/134 |
| 3,041,864 | 7/1962 | Czech | 68/18 FA |
| 3,285,040 | 11/1966 | Bochan | 68/134 |
| 3,381,505 | 5/1968 | Smith | 68/18 FA |
| 3,543,541 | 12/1970 | Wasemann | 68/18 FA |
| 3,648,486 | 3/1972 | Rosinski, Jr. et al. | 68/134 X |
| 4,003,225 | 1/1977 | Worst | 68/18 FA |

FOREIGN PATENT DOCUMENTS

| | | | |
|---|---|---|---|
| 237132 | 1/1962 | Australia | 68/18 FA |

*Primary Examiner*—Philip R. Coe

*Attorney, Agent, or Firm*—Hill, Van Santen, Steadman, Chiara & Simpson

[57] ABSTRACT

A filter for use in a vertical axis automatic clothes washing machine mounted on the exterior of a two section separable agitator and which projects into a fluid flow path. The exterior section is easily removable, cleanable and replaceable. The filter is formed as a double cone with inlet openings on one side and a foraminous filter surface on the other side.

10 Claims, 6 Drawing Figures

Fig. 1
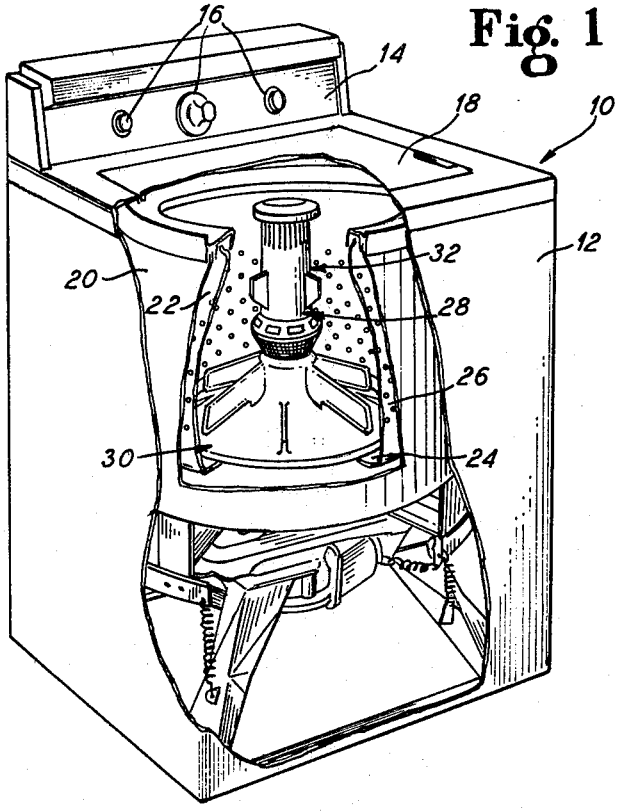
Fig. 6
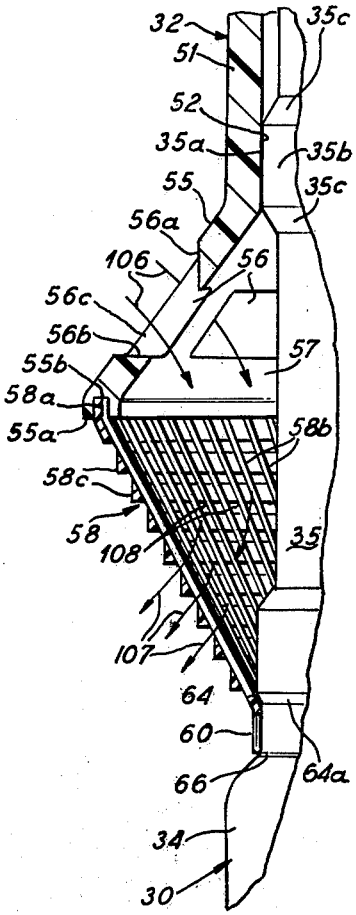
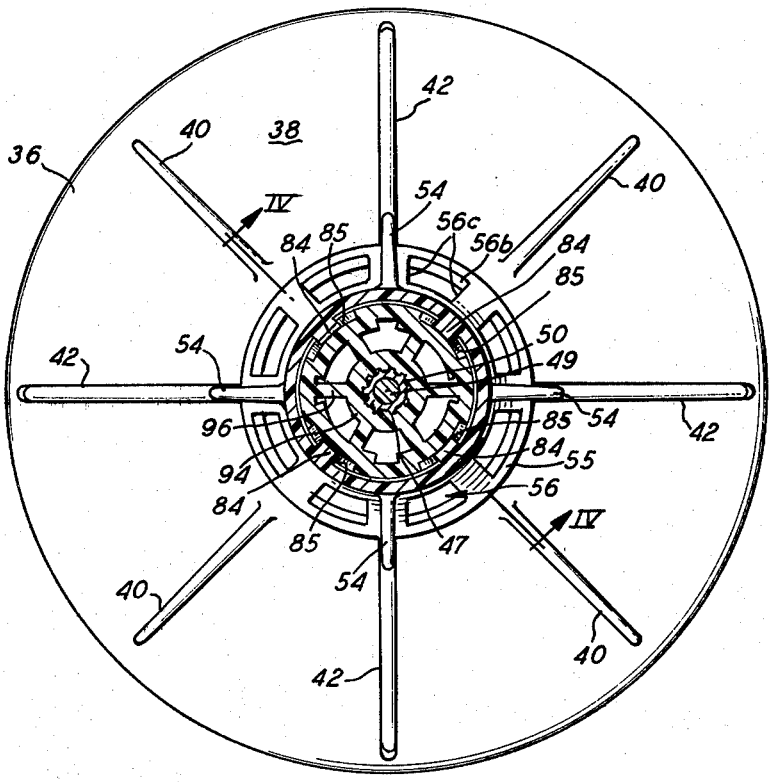
Fig. 3

AGITATOR MOUNTED FILTER FOR AN AUTOMATIC WASHER

BACKGROUND OF THE INVENTION

1. Field of the Invention

This invention relates to automatic clothes washing machines and in particular to an agitator carried filter for use therein.

2. Description of the Prior Art

Agitator carried filters are known in the prior art as exemplified by U.S. Pat. Nos. 4,003,225; 3,543,541 and 3,381,505. The prior art exemplified by the latter two cited references provide for the toroidal flow of wash fluid within the washing machine to enter holes formed in the agitator post body or extension thereof and to flow through the agitator body and exit from beneath the flared skirt of the agitator. This requires the filter element to be carried within the agitator body and necessitates removal of the agitator body to gain access to the filter element for cleaning thereof. This requires a multiple step disassembly and reassembly procedure for the user of the washing machine when cleaning is required. Further, the filter element is not readily visible to the user until the agitator body is disassembled.

The prior art exemplified by U.S. Pat. No. 4,003,225 provides for filter elements to be carried on the outside of the agitator body adjacent the skirt portion of the agitator and positioned between the adjacent vanes. For efficient filtering, this type of device requires a plurality of filter elements, each to be provided between a pair of vanes. Thus, disassembly of several parts and reassembly thereof is required during the cleaning operation. Further, the filter elements are located near the bottom of the wash receptacle which may result in restricted viewing thereof, especially in poorly illuminated laundry facilities. Thus, the disassembly and reassembly procedures may be hindered and visual observation of the filter element within the wash receptacle may not be feasible.

SUMMARY OF THE INVENTION

The present invention provides for a two-piece agitator for use in a vertical axis clothes washing machine. The inner agitator section has a vertical central post or hub and is comprised of four rigid vanes formed on the flared skirt of the agitator and four flex vanes formed on the hub adjacent the skirt. The outer agitator section is comprised of a hollow barrel which fits over the upper portion of the inner hub or post.

The barrel has mounted thereon four small rigid vanes which act in cooperation with the vanes on the inner agitator section. Also carried on the barrel near the lower end is a conical flange which has a plurality of openings therein. Affixed to the bottom of the flange is an inverted conical section comprising a filter which forms the bottom of the outer agitator section.

The inner agitator section includes an annular groove positioned axially above the flexible vanes on the hub and is used for retaining the outer agitator section. The inner agitator section is provided with four cam shaped lobes defining channels therebetween for engagement with four drive lugs located on the inner surface of the outer agitator section. The channels flare out at the top opening such that the drive lugs can be easily aligned as the outer agitator section is pressed downwardly over the inner agitator section. The bottom of the filter element has a friction ring molded to it which is received and retained in the annular groove formed on the post of the inner agitator section.

The filter element is thus carried on the exterior of the agitator, readily viewable by the user of the washing machine. The placement of the filter element above the flexible vane portion of the inner agitator section allows for easier viewing.

Further, the filter element is removable in a one-step operation by simply pulling vertically upward on the outer agitator section, grasping a gripping knob provided, releasing the friction ring from the annular groove and thereby separating the outer agitator section from the inner agitator section. The filter element can be held under a running water faucet for cleaning and then replaced on the hub of the inner agitator section by reversing the above step. Specifically, the outer agitator barrel portion is placed over the inner post and is pushed axially downwardly. Since the channels formed in the post are flared out at the top, the drive lugs are guided into alignment with the lobes automatically and without the need for visual alignment by the user.

In operation, the agitator is moved in an oscillating manner whereby the vanes induce a torodial fluid flow by centrifugal force. The fluid flows downwardly adjacent the agitator barrel and a portion of the fluid flows through the openings in the conical flange, through the inverted conical filter and back into the main flow path of the fluid thereby removing lint and other particles from the wash fluid.

Thus the invention provides for an agitator carried filter which removes lint and other particles from the wash fluid and is highly visible and easily removable and replaceable for cleaning.

DESCRIPTION OF THE DRAWINGS

FIG. 1 is a perspective cut-away view of an automatic clothes washing machine showing a vertical axis agitator embodying the present invention.

FIG. 3 is a sectional view of the agitator along the lines III—III of FIG. 2.

FIG. 6 is a fragmentary sectional view of the filter element carried on the agitator.

DESCRIPTION OF THE PREFERRED EMBODIMENTS

Figure 2:
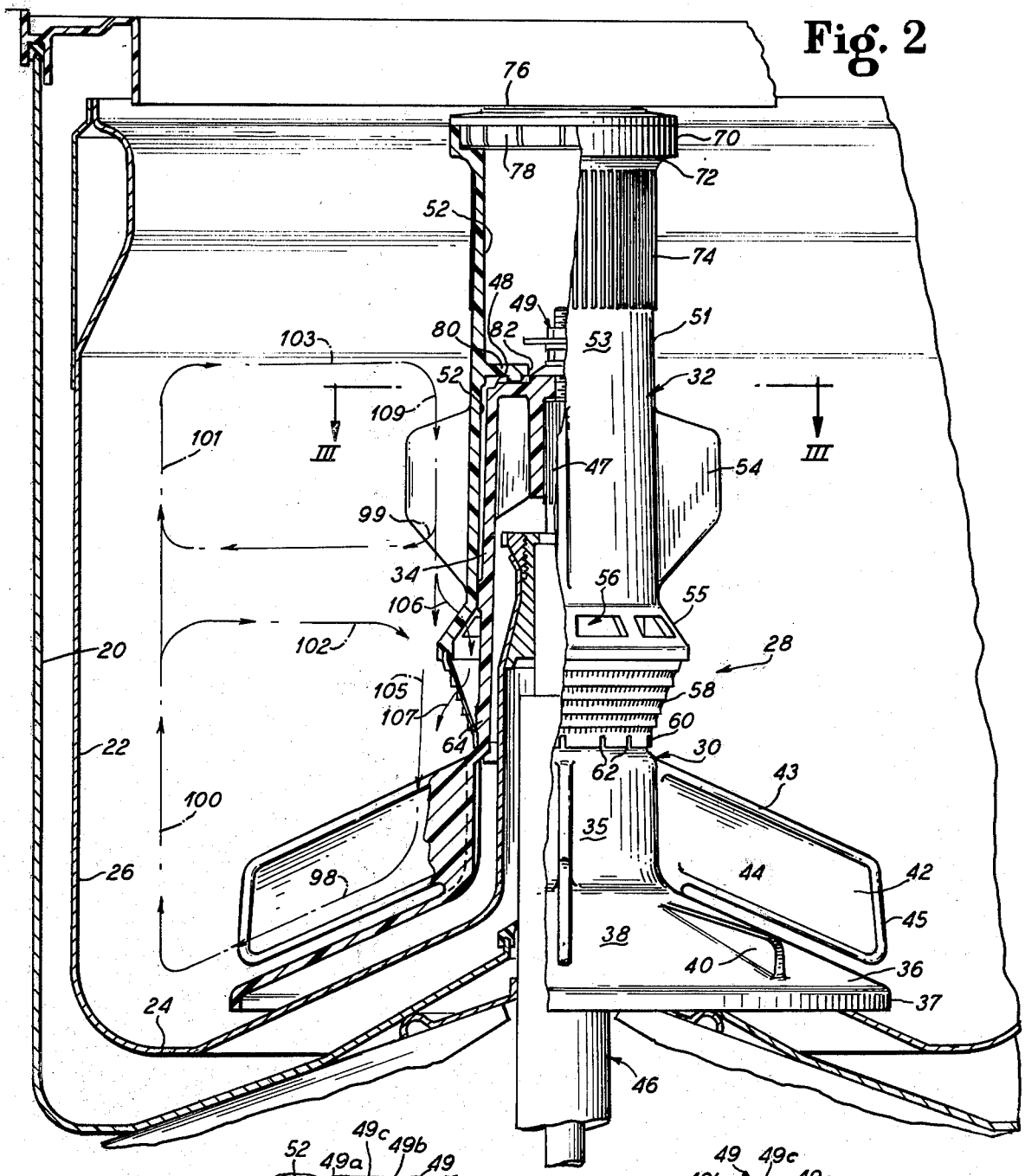
FIG. 2 is a fragmentary sectional view taken through the tub of the washing machine shown in FIG. 1.

A washing machine 10 of the automatic, vertical axis type, shown generally in FIG. 1, comprises a cabinet 12 having a control panel 14 with a plurality of control knobs and indicators 16 associated with a pre-settable sequential control means. A hinged lid 18, for permitting access to the interior of the machine 10 allows a batch of materials to be laundered to be placed within the cabinet 12 in an imperforate fluid retaining tub 20 and a perforate washing receptacle or basket 22 mounted coaxially therewithin and together forming a treatment zone in which the materials are automatically and sequentially laundered in a programmed sequence of washing, rinsing and drying steps. The basket 22 has a lower wall 24 and a side wall 26, the wall 26 being generally cylindrical. An agitator assembly 28 is mounted coaxially within the tub 20 and the basket 22.

The agitator assembly 28 is comprised of two sections, an inner agitator section 30 and an outer agitator section 32. As best seen in FIG. 2, the inner agitator section 30 comprises an upstanding center post or hub 34 having an exterior surface 35 with a lower flared skirt 36 having an outer circumferential wall 37. Mounted on an upper portion 38 of the skirt 36 are four equidistantly spaced rigid vanes 40 which are vertically upstanding and extend radially outwardly along a portion of the radius of the skirt 36.

Formed on the center post 34 are four flexible vanes 42, each having a top rib 43, a bottom rib 44 and an end rib 45. The vanes 42 are vertically upstanding and project radially outwardly from the hub 34. The lower rib 44 is generally parallel to, but spaced apart from the upper portion 38 of the skirt 36. The flexible vane 42 extends radially outwardly such that the end rib 45 is proximate to the outer circumferential wall 37 of the skirt 36.

As seen in FIG. 3, the four rigid vanes 40 are spaced rotationally equally apart from each other on the upper portion 38 of the skirt 36 and the flexible vanes 42 are spaced rotationally equally apart from each other with each flexible vane 42 being spaced equidistantly between two adjacent rigid vanes 40.

Figure 4:
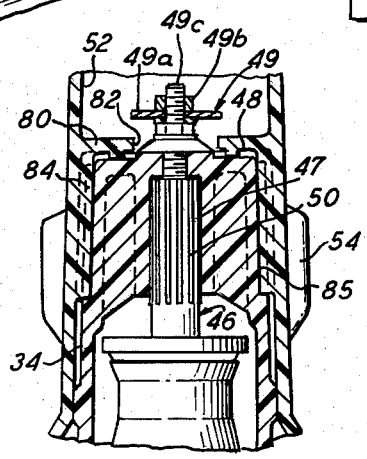
FIG. 4 is a sectional view of the driving means of the agitator along lines IV—IV of FIG. 3.

Referring to FIGS. 2 and 4, it is seen that the inner agitator section 30 is mounted concentrically about a central drive means 46 and is operably connected thereto by means of a spline connection 47 near a top wall 48 of the hub 34. An appropriate fastening means 49 retains the hub 34 axially against a splined portion 50 of the drive means 46.

The outer agitator section 32 is comprised of a hollow barrel 51 having an interior surface 52 which is sized to fit concentrically around the outside of the center post 34 of the inner agitator section 30. Mounted on an exterior surface 53 of the barrel 51 are four small rigid vanes 54 which are disposed vertically and project radially outwardly from the exterior surface 53. As best seen in FIG. 3, the small vanes 54 are linearly aligned with the flexible vanes 42.

Referring to FIGS. 2 and 6, the lower portion of the outer agitator section 32, which is generally cylindrical in configuration, slants generally radially outwardly and axially downwardly to form a generally conical wall or flange 55.

The flange 55 has a circumferential row of spaced apart relatively large openings 56, each bounded on its upper side by a vertical wall **56*a* and at its lower side by a horizontal wall 56*b*. The ends of each opening 56 are bounded by vertical divider walls 56*c*. As shown in FIG. 3, there are eight such openings 56 disposed so that two openings are in each 90° quadrant, thereby insuring adequate flow passageways into an interior hollow annular space 57 inwardly of the flange 55 and outwardly of the exterior surface 35 of the hub 34**.

The flange 55 terminates in a lip or wall **55*a* recessed as at 55*b* to receive and seat mating rim 58*a* of a conically shaped filter means or screen 58 forming a lower end of outer agitator section 32**.

The rim **58*a* of the filter screen 58 is circumferentially continuous and is attached in firm assembly with the adjoining wall of the recess 55*b* by spin welding, it being understood that both flange 55 and screen 58** are made of suitable plastic material which lends itself to that form of fusion bonding. Other modes of attachment such as by the use of suitable adhesives could also be employed.

The filter screen 58 has a screen network formed by a plurality of closely spaced longitudinal or axial spines **58*b* all of which are spaced circumferentially apart from one another and a plurality of axially spaced circumferentially continuous bars 58*c* intersecting the spines 58*b* to form interstices 108. Together the spines 58*b* and bars 58*c*** form a foraminous filter surface for separating filterable materials from laundry liquid.

The filter screen 58 is generally conical in its overall external configuration, tapering inwardly from its widest dimension at the rim **58*a* towards an inner circumferential and axially extending collar or friction ring 60**.

The top of the hollow space 57 is closed off by an abutment contact between inner cylindrical surface 52 of hollow barrel 51 and an adjoining cylindrical surface **35*a* formed on an enlarged embossment 35*b* provided on the hub 34. The cylindrical surface 35*a* is bounded on its upper and lower ends by a tapered shoulder 35*c*. The hollow space 57** is thus configured as an annular filter zone in which the debris and lint laden laundry liquid will pass and the separated materials can be temporarily stored therein for selective removal by the machine operator.

The friction ring 60 is provided as an intergral part of the filter screen 58 and has formed therein a plurality of slits 62 (FIG. 2) which permit the friction ring 60 to expand over a retaining ring 64 formed on the exterior surface 35 of the hub 34 during removal or replacement of the outer agitator section 32. When the outer agitator section 32 is in place about the inner agitator section 30, the friction ring 60 is retained within an annular groove 66 formed in the hub 34 of the inner agitator section 30, just below the retaining ring 64. A tapered shoulder **64*a* conformably engages the adjoining portions of the filter member 58. The annular groove 66 is located just above the top rib 43 of the flexible vanes 42. Thus, all liquid passing downwardly through the openings 56 and into the annular space 57 will tend to be drawn through the foraminous filter screen 58 by the oscillating action of vanes 42. The conically shaped filter 58 thus forms more or less of a filter basket for collecting lint and debris in the hollow annular space 57**.

A gripping knob or lip 70, as best seen in FIG. 2, is formed at the top end of the outer agitator section 32 and comprises an annular member of a larger diameter than the barrel 51. A curved abutment surface 72 forms the bottom of the gripping lip 70 which may be grasped by the finger tips of a user or can be used as an abutment surface for the entire length of the index finger and thumb of the user when the hand is placed circumferentially around the barrel 51 in a gripping manner. A decorative ribbed section 74 is provided immediately below the curved abutment surface 72 to enhance the aesthetics of the article. A cover 76 is provided for the top of the outer agitator section 32 and is frictionally retained in the top of the gripping knob 70 by means of a slotted friction ring 78.

The interior surface 52 of the hollow barrel 51 of the outer agitator section 32 is provided with a perpendicular spacing wall 80 which abuts against the top wall 48 of the center post 34 of the inner agitator section 30 as best seen in FIG. 4. A central circular opening 82 is provided in the spacing wall 80 to allow clearance for the fastening means 49 which hold the inner section 30 to the drive means 46. The fastening means includes a flexible washer **49*a* held in place by a nut 49*b* on threaded fastener 49c. The washer 49a is slightly larger than opening 82 so that the washer must be deformed slightly when the outer section 32 is removed or installed. This provides a means in addition to friction ring 60 for maintaining outer section 32 in position on inner section 30**.

Figure 5:
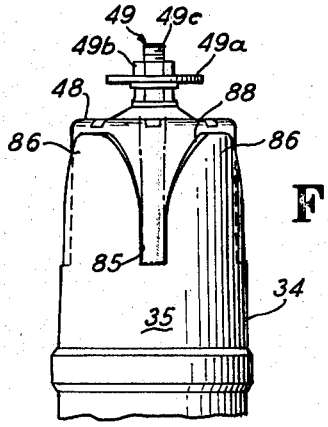
FIG. 5 is a fragmentary side elevational view of the top of the inner agitator section shown in FIG. 4 with the outer agitator section removed.

Four axially extending and radially inwardly projecting drive lugs 84 are equidistantly spaced about the interior circumferential surface 52 of the outer agitator section 32 adjacent to and immediately below the spacing wall 80. Each of the drive lugs 84 is designed to be received in a channel 85 formed between a pair of cam shaped lobes 86 which are provided at the top of the center post 34 of the inner agitator section 30 as best seen in FIG. 5. The channels 85 flare out at a top opening 88 such that the drive lugs 84 can be easily aligned as the outer agitator section 32 is pressed downwardly over the inner agitator section 30 during assembly or during replacement of the outer agitator section 32 after a cleaning operation. The cylindrical surface 35a of enlarged embossment 35b which abuts against inner surface 52 of the outer agitator section 32 to provide radial stability for the outer agitator section 32 during operation is formed just below channels 85.

The internal and external arrangement of the parts is best seen in FIG. 3. The fastening means 49 is shown at the center of the Figure and is received and retained within the spline portion 50 of the central drive means 46. There is a spline connection 47 between the central drive means 46 and the inner agitator section 30 through the use of an internal hub 94 retained and spaced within the interior of the inner agitator section 30 by means of a plurality of webs 96. The drive lugs 84 are received within the channels 85 and are placed so as to be radial in alignment with the rigid vanes 40. The small rigid vanes 54 of the outer agitator section 32 are in radial alignment with the flexible vanes 42. The conical flange 55 projects beyond the diameter of the outer agitator section 32 and contains the plurality of openings 56 therethrough.

During operation, the central drive means 46 through the spline connection 47 drives the agitator assembly 28 in a rotational oscillating manner. The rotation of the vanes 40, 42 and 54 causes wash fluid within the washing receptacle 22 to flow radially outwardly adjacent the vanes as shown in FIG. 2 by arrows 98, 99. The wash fluid then flows upwardly along the side wall 26 of the washing receptacle 22 as shown by arrows 100, 101. The wash fluid flow is then drawn radially inwardly as at arrows 102, 103 toward the agitator assembly 28 where it is drawn downwardly as shown by arrows 104, 105 toward the vanes to repeat the torodial flow path.

As shown in FIGS. 2 and 6, a portion of the wash fluid flowing downwardly adjacent the agitator assembly 28 flows in through openings 56 in the conical flange 55 as shown by arrows 106. The wash fluid flows through the interior of the inverted conical section filter means 58 and exits back into the wash fluid flow, shown by arrows 107. In this manner lint and other particles are filtered from the wash fluid preventing their deposit on clothing being washed within the washing receptacle 22.

As is apparent from the foregoing specification, the invention is susceptible of being embodied with various alterations and modifications which may differ particularly from those that have been described in the preceeding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. In a vertical axis washing machine having a wash receptacle, a drive means and an agitation means within said receptacle driven by said drive means; said agitation means comprising:

an inner oscillatory agitator section having a vertical central hub having an upper portion and including a bottom portion forming a skirt and a plurality of vanes, said vanes mounted adjacent said skirt formed at the bottom of said hub, and an outer oscillatory agitator section comprising a barrel fitting over said upper portion of said inner agitator hub, said outer agitator section forming a lower portion and having a conical flange having openings therethrough formed near said lower portion, and an inverted conical section comprising a filter means affixed to said flange, said filter means forming a lower end of said outer agitator section, whereby said vanes impel liquid in said wash receptacle to flow down along the barrel of the outer agitator section, in through said flange openings and out through said filter means to separate filterable substances from said liquid.

2. The apparatus of claim 1, wherein said outer agitator section is removably retained on said inner agitator section by means of a friction ring formed on said outer agitator section.

3. The apparatus of claim 1, wherein said inner oscillatory agitator section vertical central hub comprises a plurality of rigid vanes mounted on an upper portion of said skirt formed at said bottom of said agitator section and a plurality of flexible radially projecting vanes mounted on said hub adjacent said skirt.

4. The apparatus of claim 3, wherein said outer agitator section is provided with a plurality of small radially projecting vanes near the middle of said barrel and said small vanes are radially aligned with said flexible vanes.

5. The apparatus of claim 4, wherein channels are formed in said hub of said inner agitator, and drive lugs are provided on the interior of said barrel of said outer agitator to be received in said channels to drive said outer agitator co-rotationally with said inner agitator.

6. The apparatus of claim 1, wherein said outer agitator section has a middle portion and is provided with a plurality of small radially projecting vanes from said middle portion of said barrel.

7. The apparatus of claim 1, wherein said outer agitator section is provided with a gripping knob at a top end thereof.

8. A washing machine agitator comprising:

a centrally disposed post having a pair of spaced embossments forming a cylindrical surface with spaced shoulders;

an externally disposed barrel having a telescoping relation with said post and including a first cylindrical abutment surface engaging one of said embossments;

said barrel including an outwardly extending axially projecting wall terminating in a recessed lip and having a plurality of relatively large inlet openings formed therein; and a filter basket including a rim received and seated in said recessed lip, said basket tapering inwardly and projecting axially for termination at a collar embracing the other of said embossments;

said filter basket having a foraminous filter surface to separate lint and debris from laundry liquid passing therethrough;

said post, barrel and basket together forming an annular filter zone through which laundry liquid may be directed during the washing cycle of a laundry process.

9. The invention of claim 8, wherein said agitator is made of plastic and said rim and lip are welded into firm assembly with one another.

10. The invention of claim 9, wherein said collar has axial slits formed therein to enhance selective removal of the outer section from the post to clean the filter surface.

* * * * *